US007621518B2

(12) United States Patent
Iesaki et al.

(10) Patent No.: US 7,621,518 B2
(45) Date of Patent: Nov. 24, 2009

(54) IMAGE RECORDING APPARATUS

(75) Inventors: Kenichi Iesaki, Ichinomiya (JP); Shigeki Akiyama, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 12/202,959

(22) Filed: Sep. 2, 2008

(65) Prior Publication Data

US 2009/0066018 A1 Mar. 12, 2009

(30) Foreign Application Priority Data

Aug. 30, 2007 (JP) ..... 2007-224300

(51) Int. Cl.
*B65H 5/22* (2006.01)
*B65H 83/00* (2006.01)
*B65H 85/00* (2006.01)

(52) U.S. Cl. ..... 271/3.14; 271/3.15; 271/3.17; 271/3.18; 271/3.2

(58) Field of Classification Search ..... 271/3.14, 271/3.15, 3.17, 3.18, 3.2, 272; 347/104
See application file for complete search history.

(56) References Cited

U.S. PATENT DOCUMENTS 5,598,201 A * 1/1997 Stodder et al. ..... 347/104
6,598,869 B2 * 7/2003 Johnson et al. ..... 271/3.15
6,783,290 B2 * 8/2004 Sussmeier ..... 400/608.4
2006/0250468 A1 * 11/2006 Nakamura ..... 347/104
2006/0279597 A1 12/2006 Ishimoto et al.
2007/0018386 A1 * 1/2007 Maruyama et al. ..... 271/272
2007/0031175 A1 2/2007 Takeda et al.
2007/0229565 A1 * 10/2007 Imai ..... 347/16

FOREIGN PATENT DOCUMENTS

| | | |
|---|---|---|
| JP | 2004-123313 | 4/2004 |
| JP | 2006-82425 | 3/2006 |
| JP | 2006-224380 | 8/2006 |
| JP | 2006-346938 | 12/2006 |
| JP | 2007-63016 | 3/2007 |

* cited by examiner

*Primary Examiner*—David H Bollinger
(74) *Attorney, Agent, or Firm*—Scully, Scott, Murphy & Presser, P.C.

(57) ABSTRACT

An image recording apparatus includes a record unit; a first roller provided upstream of the record unit; a second roller provided downstream of the record unit; a motor which drives the first and second rollers; a first drive signal generation unit which generates a first drive signal based on a first rotation amount of the first roller and a first target rotation amount; a correction value generation unit which generates a correction value based on the first rotation amount and a second rotation amount of the second roller; a target value generation unit which generates a second target rotation amount based on the first target rotation amount and the correction value; a second drive signal generation unit which generates a second drive signal based on the second target rotation amount and the second rotation amount; and a controller which controls the motor by the first drive signal until a conveyed sheet reaches a position and controls the motor by the second drive signal thereafter.

12 Claims, 7 Drawing Sheets

IMAGE RECORDING APPARATUS

CROSS-REFERENCE TO RELATED APPLICATION

This application claims priority from Japanese Patent Application No. 2007-224300, filed on Aug. 30, 2007, the entire subject matter of which is incorporated herein by reference.

TECHNICAL FIELD

Aspects of the present invention relate to an image recording apparatus for recording an image on a sheet conveyed along a conveying passage.

BACKGROUND

In an image recording apparatus such as an ink jet printer, when a print start command is given, a record sheet is fed from a tray to a conveying passage. The conveying passage is provided with a roller pair. The roller pair includes a main roller which is rotated and an auxiliary roller pressed against the main roller and supported to be freely rotatable. The main roller is rotated with a record sheet sandwiched between the roller pair, whereby the record sheet is conveyed along the conveying passage. An image is recorded on the record sheet while the record sheet is conveyed along the conveying passage. A related-art image recording apparatus is provided with means for controlling rotation of the main roller. (For example, refer to JP-A-2004-123313 or JP-A-2006-82425)

JP-A-2004-123313 describes an image recording apparatus in which a conveying roller provided upstream from a recording head and a sheet discharge roller provided downstream are joined via a plurality of gears. Thus, a drive force transmitted from a motor to the conveying roller is also transmitted to the sheet discharge roller and the conveying roller and the sheet discharge roller rotate. The image recording apparatus is provided with a rotary encoder for detecting the rotation amount of the conveying roller. Rotation of the motor is controlled based on the detection result of the rotary encoder.

JP-A-2006-82425 describes a printer in which a first conveying roller pair is provided upstream in a conveying passage with respect to a thermal bead and a second conveying roller pair is provided downstream of the conveying passage with respect to the thermal head. The printer is also provided with a first encoder for detecting the rotation amount of the first conveying roller pair and a second encoder for detecting the rotation amount of the second conveying roller pair. A clutch for switching transmission of a drive force from a conveying motor is provided between the conveying motor and the first conveying roller pair and between the conveying motor and the second conveying roller pair. The transmitting passage of the drive force is switched by the clutch, whereby the drive force is transmitted from the conveying motor only to one conveying roller pair and the other conveying roller pair enters a free state in which no drive force is transmitted. In the printer, the rotation amount of the free roller pair is detected by the first or second encoder and the conveying motor is controlled based on the detection result of the encoders. Accordingly, rotation of the roller pair to which the drive force is transmitted is adjusted.

However, in the configuration in which a record sheet is conveyed in one direction by the two main rollers, although the same drive force is given to the two main rollers, the rotation amounts thereof do not match due to the effect of eccentricity or a dimension error of the shaft of the main roller, an attachment error of a drive transmission mechanism for transmitting rotation of the motor to the main roller, and the like. Thus, the conveying distance of a record sheet might change at the change timing from the state in which the record sheet is conveyed by the two main rollers to the state in which the record sheet is conveyed only by the downstream main roller, for example. Consequently, turbulence might occur in the image recorded on the record sheet.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image recording apparatus capable of reducing or preventing occurrence of turbulence in the image recorded on a sheet of a record sheet, and the like.

According to an exemplary embodiment of the present invention, there is provided an image recording apparatus including: a record unit which records an image on a record medium conveyed in a conveying direction in a conveying passage; a first roller which is provided upstream of the record unit in the conveying direction in the conveying passage; a second roller which is provided downstream of the record unit in the conveying direction in the conveying passage; a motor which drives the first roller and the second roller; a drive transmission mechanism which transmits a drive force of the motor to the first roller and the second roller; a first detection unit which detects a first rotation amount of the first roller; a second detection unit which detects a second rotation amount of the second roller; a storage unit which stores a first target rotation amount; a first drive signal generation unit which generates a first drive signal based on the first rotation amount detected by the first detection unit and the first target rotation amount stored in the storage unit; a correction value generation unit which generates a correction value based on the first rotation amount detected by the first detection unit and the second rotation amount detected by the second detection unit; a target value generation unit which generates a second target rotation amount based on the first target rotation amount stored in the storage unit and the correction value generated by the first correction generation unit; a second drive signal generation unit which generates a second drive signal based on the second target rotation amount generated by the second generation unit and the second rotation amount detected by the second detection unit; and a controller which controls the motor by the first drive signal until the conveyed record medium reaches a predetermined position in the conveying passage and controls the motor by the second drive signal after the conveyed record medium reaches the predetermined position.

According to another exemplary embodiment of the present invention, there is provided an image recording apparatus including; first roller pair and second roller pair which convey a record medium in a conveying passage in a conveying direction; a record unit which records an image on the record medium; a motor; a transmission mechanism which transmits a rotation of the motor to the first roller pair and the second roller pair; first and second detection units which detect a first rotation speed of the first roller pair and a second rotation speed of the second roller pair, respectively; a rotation ratio calculating unit which calculates a ratio of the second rotation speed to the first rotation speed; and a controller which controls the motor with using the ratio calculated by the rotation calculating unit.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Referring to the accompanying drawings, there will be described exemplary embodiments of the present invention. The exemplary embodiment is mere example of the present invention and can be changed as required without departing from the sprit and the scope of the present invention.

The configuration and the operation of a multifunction device (MFD) 10 according to an exemplary embodiment of an image recording apparatus of the present invention will be described.

<Schematic Configuration of Multifunction Device 10>

Figure 1:
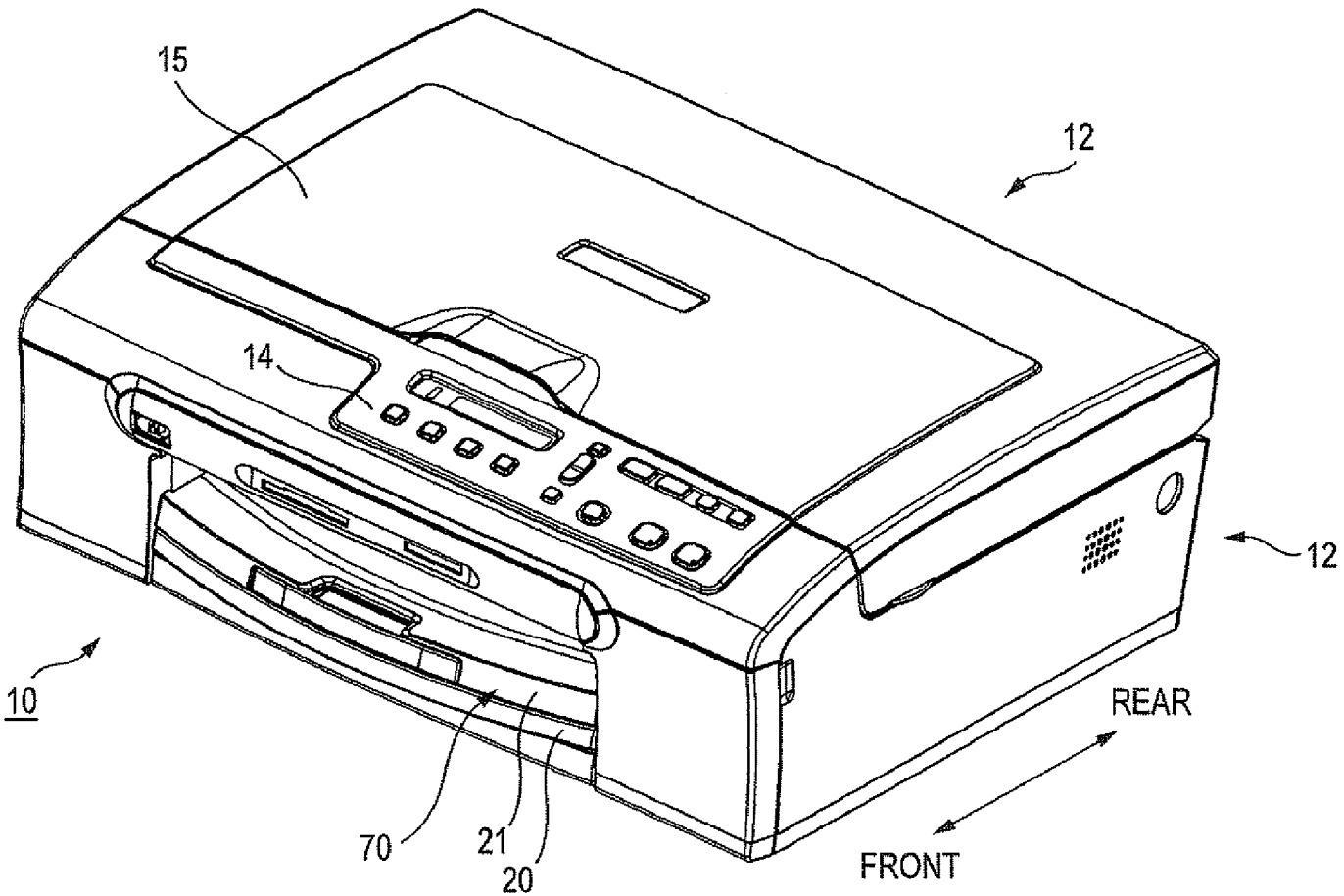
FIG. 1 is a perspective view to show the external configuration of a multifunction device according to an exemplary embodiment of the present invention.

FIG. 1 is a perspective view to show the external configuration of the multifunction device 10. The multifunction device 10 includes a printer unit 11 and a scanner unit 12 integrally and has various functions of a print function, a scan function, a copy function, a facsimile function, and the like. The present invention can be applied not only to the multifunction device 10 having a plurality of functions, but also to an image recording apparatus having at least a print function.

As shown in FIG. 1, the multifunction device 10 has a wide and slim outside shape of a substantially rectangular parallelepiped having a width and a depth larger than a height. The upper part of the multifunction device 10 includes the scanner unit 12. The scanner unit 12 is implemented as a flatbed scanner. As shown in FIG. 1, as a top plate of the multifunction device 10, a document cover 15 is provided so that it can be opened and closed. Platen glass and an image sensor (not shown) are provided in a main body below the document cover 15. An image of the document placed on the platen glass is read through the image sensor. The scanner unit 12 is an optional component and therefore will not be described in detail.

The lower part of the multifunction device 10 includes the printer unit 11. The printer unit 11 records an image on a sheet based on the image data of the document read through the scanner unit 12 and externally input print data. The printer unit 11 is provided with a sheet cassette 70 having a sheet feed tray 20 and a sheet discharge tray 21. A record sheet 50 (see FIG. 2) housed in the sheet feed tray 20 is fed into the printer unit 11. The printer unit 11 is provided with a record unit 24 (see FIG. 2) for recording an image. The record unit 24 records any desired image on the record sheet 50 fed from the sheet feed tray 20.

An operation panel 14 is provided on the top of the front of the multifunction device 10. The operation panel 14 includes a liquid crystal display for displaying various pieces of information, input keys for the user to enter information, and the like. The printer unit 11 and the scanner unit 12 operate based on a command signal input through the operation panel 14 and a command signal transmitted using a printer driver or a scanner driver from an external system.

<Configuration of Printer Unit 11>

Figure 2:
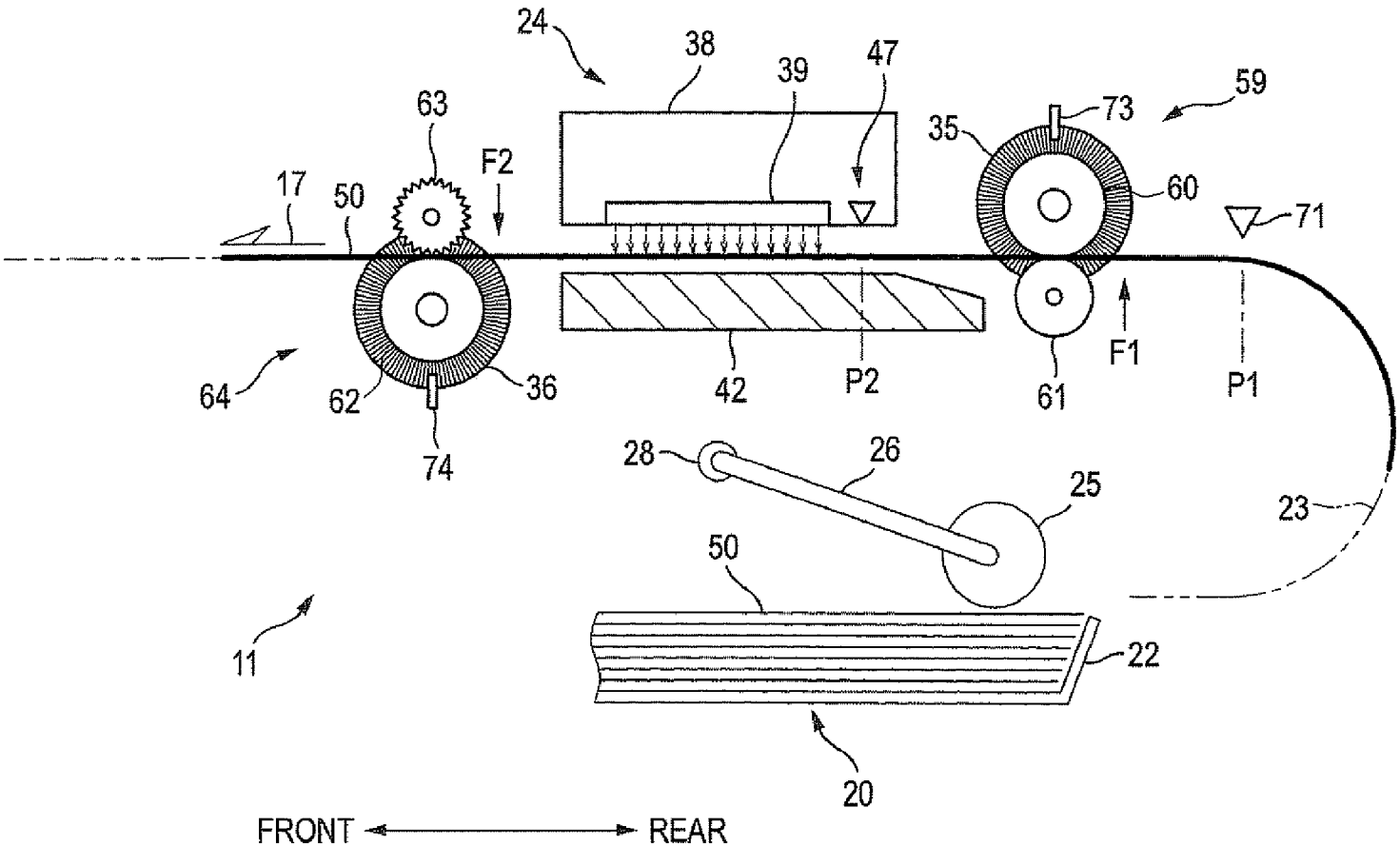
FIG. 2 is a schematic sectional view to show the internal configuration of a printer unit in the multifunction device.

The configuration of the printer unit 11 will be described with reference to FIG. 2. FIG. 2 is a schematic sectional view to show the internal configuration of the printer unit 11. In FIG. 2, the sheet discharge tray 21 and a part of the sheet feed tray 20 are not shown.

The sheet feed tray 20 is placed on the bottom of the printer unit 11 (see FIGS. 1 and 2). As shown in FIG. 2, a slope plate 22 is provided at the back of the sheet feed tray 20 (the right in FIG. 2). The slope plate 22 is inclined so as to fall to the rear of the apparatus (the right in FIG. 2). The slope plate 22 guides the record sheet 50 upward from the sheet feed tray 20. A conveying passage 23 is provided above the slope plate 22. The conveying passage 23 is a passage in which the record sheet 50 is conveyed; a part of the passage is bent. Specifically, the conveying passage 23 extends upward from the slope plate 22 and then is bent to the front of the multifunction device 10 (the left in FIG. 2) and is extended through the record unit 24 to the sheet discharge tray 21 (see FIG. 1).

As shown in FIG. 2, a sheet feed roller 25 is provided above the sheet feed tray 20. The sheet feed roller 25 comes in press contact with the record sheet 50 at the top position of the sheet feed tray 20 and feeds the record sheet 50 to the conveying passage 23. An arm 26 is provided rotatably on a shaft 28 supported on a frame (not shown) of the printer unit 11. The sheet feed roller 25 is rotatably supported at the tip of the arm 26. The arm 26 is urged in a rotation manner toward the sheet feed tray 20 with own weight thereof or upon reception of an elastic force of a spring, and the like. A drive force of a motor (not shown) is transmitted to the sheet feed roller 25 through a power transmission device (not shown) provided in the shaft 28 and the arm 26. When the drive force is transmitted to the sheet feed roller 25 in a state in which the sheet feed roller 25 abuts the record sheet 50, the topmost record sheet 50 in the sheet feed tray 20 is taken out by the sheet feed roller 25 and is fed to the conveying passage 23.

A platen 42 is provided downstream in a conveying direction 17 from the bend part of the conveying passage 23. The platen 42 supports the record sheet 50 conveyed in the conveying passage 23 from below. The record unit 24 is provided above the platen 42. In the exemplary embodiment, the record sheet 50 is conveyed in one direction without being conveyed backwardly at least until image recording on the record sheet 50 is complete. The conveying direction 17 in FIG. 2 indicates the one direction.

The record unit 24 includes a carriage 38. The carriage 38 can reciprocate in a direction perpendicular to the plane of FIG. 2, namely, a direction substantially orthogonal to the conveying direction 17 (hereinafter referred to as "scanning direction"). The carriage 38 reciprocates at a predetermined timing by a related-art belt drive mechanism. An ink jet record head (hereinafter simply referred to as "record head") 39 and an optical sensor 47 are mounted on the carriage 38. Thus, the record head 39 and the optical sensor 47 reciprocate in the scanning direction together with the carriage 38. While the carriage 38 reciprocates, minute ink droplets are selectively ejected toward the platen 42 from the record head 39. An image is recorded by the record unit 24 on the record sheet 50 conveyed on the platen 42 in the conveying process.

As shown in FIG. 2, the optical sensor 47 is placed upstream of the record head 39 in the conveying direction 17 (hereinafter simply referred to as "upstream"). The optical sensor 47 is provided mainly for detecting the leading end or the trailing end of the record sheet 50. Although not shown, the optical sensor 47 is implemented as a photoreflector (reflection photosensor) including a light emission part made of a light emitting diode and a light reception part. The light emission part applies light downward substantially in the vertical direction. The light reception part receives light reflected on the platen 42 or the record sheet 50. When the light reception part receives the reflected light, a detection signal responsive to the luminance of the received light (electric signal of voltage signal, current signal, or the like) is generated. The detection signal is output to a controller 100 (see FIG. 4). The color of the top face of the platen 42 is a dark color having a reflection factor lower than that of the record sheet 50. Thus, if the record side of the record sheet 50 exists substantially just below the optical sensor 47, high-luminance light reflected on the record sheet 50 is received at the light reception part and a detection signal responsive the luminance of the received light is generated. On the other hand, if the record side of the record sheet 50 does not exist just below the optical sensor 47, low-luminance light reflected on the platen 42 is received at the light reception part and a detection signal responsive the luminance of the received light is generated.

As shown in FIG. 2, a conveying roller pair 59 is provided upstream in the conveying direction 17. The conveying roller pair 59 includes a conveying roller 60 and a pinch roller 61. The conveying roller 60 is joined to a motor 85 (see FIG. 4) and is rotated intermittently in the same drive manner with a sheet discharge roller 62 described later while synchronized with each other. The motor 85 is a direct current motor (DC motor). The pinch roller 61 is supported to be freely rotatable at a position opposed to the conveying roller 60 with the conveying passage 23 therebetween. The pinch roller 61 is urged by a coil spring, and the like, for example, and is pressed into contact with the conveying roller 60 by a press contact force F1. When the leading end of the record sheet 50 reaches a nip position of the conveying roller pair 59, the conveying roller pair 59 rotates with the record sheet 50 sandwiched between therebetween. Accordingly, the record sheet 50 is conveyed toward the platen 42. The nip position is a position where the conveying roller 60 and the pinch roller 61 abut each other.

When the leading end of the record sheet 50 reaches the nip position of the conveying roller pair 59, the conveying roller pair 59 conveys the record sheet 50 a predetermined unit feed amount at one time in the conveying direction 17 with the record sheet 50 sandwiched therebetween. Specifically, the conveying roller 60 is joined to the motor 85 and the controller 100 (see FIG. 4) controls the motor 85, whereby the conveying roller 60 is rotated intermittently by rotation amount corresponding to the predetermined unit feed amount. The "predetermined unit feed amount" is the line feed width in the conveying direction 17 when an image is recorded successively on the record sheet 50 by the record head 39. To convey the record sheet 50 the predetermined unit feed amount at a time, while the carriage 38 is scanned in the scanning direction, ink droplets are ejected through the record head 39 under the control of the controller 100. The record operation is repeated, whereby an image is recorded on the record sheet 50 every predetermined unit feed amount. Consequently, a continuous image is recorded on the record sheet 50.

A discharge roller pair 64 is provided downstream of the record unit 24 in the conveying direction 17 (hereinafter simply referred to as "downstream"). The discharge roller pair 64 includes a sheet discharge roller 62 and a spur roller 63. The sheet discharge roller 62 is joined to the motor 85 (see FIG. 4) together with the conveying roller 60 and is rotated intermittently in the same drive manner with the conveying roller 60 of the conveying roller pair 59 while synchronized with each other. The spur roller 63 is supported to be freely at a position opposed to the sheet discharge roller 62 with the conveying passage 23 therebetween. The spur roller 63 is urged by a coil spring, and the like, for example, and is pressed into contact with the sheet discharge roller 62 by a press contact force F2. In the exemplary embodiment, the press contact force F2 is smaller than the press contact force F1. To protect the record side of the record sheet 50 after an image is recorded, the press contact force is set so that F2<F1. The spur roller 63 is pressed into contact with the record side of the record sheet 50. The spur roller 63 is formed on the outer peripheral surface with acute angle projections so that the image recorded on the record sheet 50 is not degraded. The discharge roller pair 64 rotates with the record sheet 50 passing through the platen 42 sandwiched therebetween. Accordingly, the record sheet 50 is conveyed (discharged) toward the sheet discharge tray 21.

The motor 85 is driven, whereby first the record sheet 50 is conveyed by the conveying roller pair 59. After the leading end of the record sheet 50 reaches a nip position of the discharge roller pair 64, the record sheet 50 is conveyed by the conveying roller pair 59 and the discharge roller pair 64. The record sheet 50 is conveyed mainly upon reception of the force of the conveying roller 60 because of the relationship between the press contact forces F1 and F2 until the trailing end of the record sheet 50 exits the nip position of the conveying roller pair 59. When the trailing end of the record sheet 50 exits the nip position of the conveying roller pair 59, the record sheet 50 is conveyed upon reception of only the force of the sheet discharge roller 62.

As shown in FIG. 2, a registration sensor 71 is provided upstream of the conveying roller 60 in the conveying passage 23. The registration sensor 71 is a sensor for detecting the record sheet 50 conveyed in the conveying passage 23. In the exemplary embodiment, the registration sensor 71 is implemented as a mechanical sensor. Specifically, the registration sensor 71 includes a photointerrupter and a feeler (sensor) supported rotatably. The photointerrupter has a light emission part for emitting light to a light reception part and the light reception part for receiving the light emitted from the light emission part. When the light reception part receives the light, a sense signal at a level responsive to the luminance of the received light (for example, an electric signal responsive to the luminance) is generated. When the record sheet 50 reaches a position P1 in FIG. 2, the record sheet 50 abuts the feeler and the feeler is rotated. Accordingly, the level of the sensor signal generated in the registration sensor 71 changes. The sensor signal generated in the registration sensor 71 is output to the controller 100 (see FIG. 4).

Figure 3:
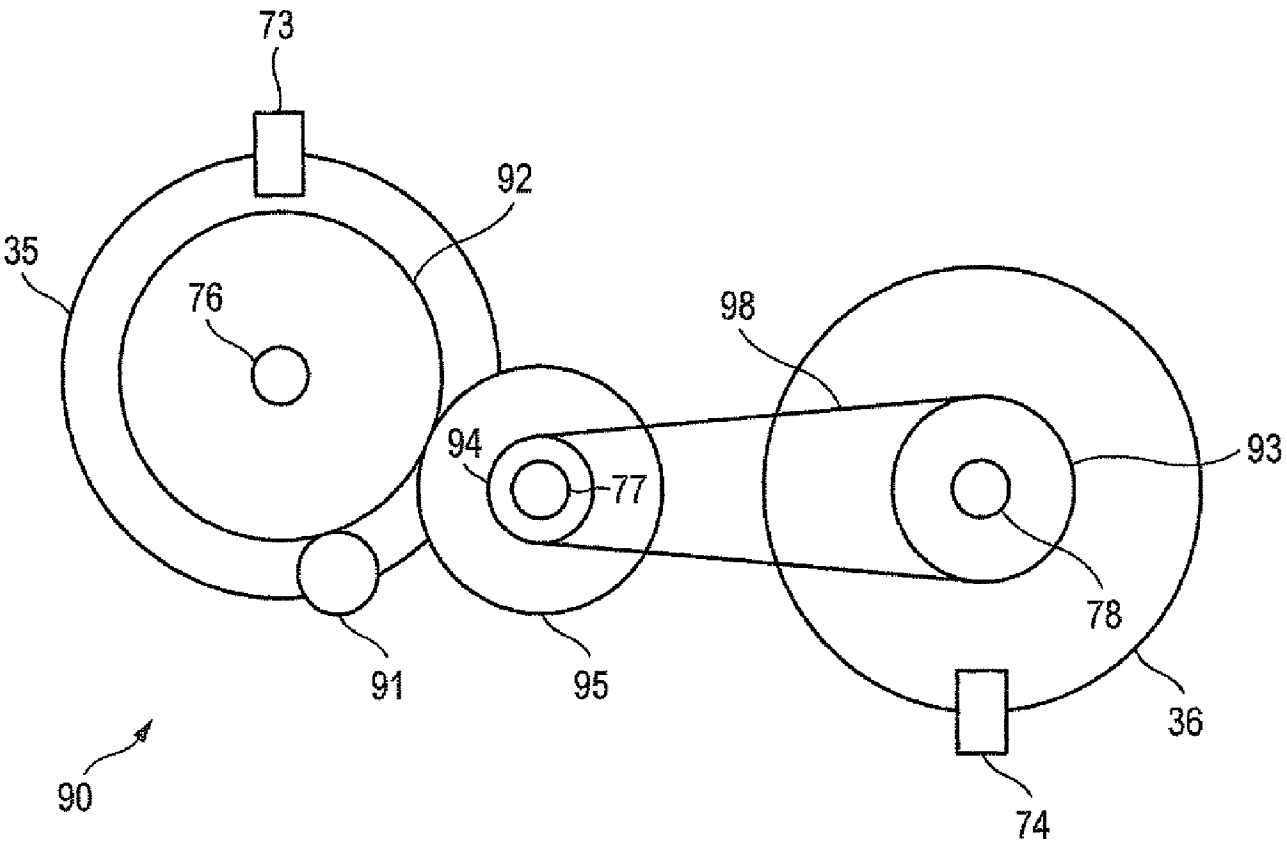
FIG. 3 is a schematic drawing to show a drive transmission mechanism in the multifunction device.

FIG. 3 is a schematic drawing to show a drive transmission mechanism 90. In FIG. 3, the conveying roller 60 and the sheet discharge roller 62 are not shown. In FIG. 3, teeth formed in a motor gear 91, a gear 92, a joint gear 95, a pulley 94, a belt 98, and a pulley 93 are not shown.

The drive transmission mechanism 90 transmits the drive force of the motor 85 to the conveying roller 60 and the sheet discharge roller 62. As shown in FIG. 3, the drive transmission mechanism 90 includes the motor gear 91, the gear 92, the joint gear 95, the pulley 94, the belt 98, and the pulley 93.

The motor gear 91 is joined to the motor 85. The gear 92 is fixed to a shaft 76 of the conveying roller 60 (see FIG. 2) and rotates around the shaft 76 together with the conveying roller 60. The gear 92 is meshed with the motor gear 91. The joint gear 95 is provided in the proximity of the gear 92. The joint gear 95 can rotate around a shaft 77. The gear 92 is also meshed with the joint gear 95. The pulley 93 is fixed to a shaft 78 of the sheet discharge roller 62 (see FIG. 2) and rotates around the shaft 78 together with the sheet discharge roller 62. The belt 98 is stretched around the pulley 94 fixed to the shaft 77 of the joint gear 95 and the pulley 93. The belt 98 is an endless annular belt provided with teeth inside the belt.

When a predetermined drive force is transmitted from the motor 85 to the motor gear 91, the drive force is transmitted to the gear 92. Accordingly, the conveying roller 60 (see FIG. 2) is rotated. The drive force transmitted to the gear 92 is also transmitted to the pulley 93 through the joint gear 95, the pulley 94, and the belt 98. Accordingly, the sheet discharge roller 62 (see FIG. 2) is rotated. That is, the conveying roller 60 and the sheet discharge roller 62 rotate synchronously by the drive force transmitted from the motor 85.

The conveying roller 60 (see FIG. 2) is provided with a first encoder disk 35 and an optical sensor 73 as shown in FIGS. 2 and 3. The first encoder disk 35 is a transparent disk rotating together with the conveying roller 60 and has radial marks at predetermined pitches. In FIG. 3, the marks are not shown. The first encoder disk 35 is fixed to the shaft 76 (see FIG. 3) of the conveying roller 60 and rotates together with the conveying roller 60. The optical sensor 73 includes a light emission element and a light reception element and is placed in the proximity of the conveying roller 60. It is placed so that the circumference of the first encoder disk 35 is positioned in the space between the light emission element and the light reception element of the optical sensor 73. When the light reception element receives light, a sense signal at a level responsive to the luminance of the received light (for example, an electric signal responsive to the luminance) is generated. A low sensor signal is generated in a state in which no mark positions between the light emission element and the light reception element. A high sensor signal is generated in a state in which a mark positions between the light emission element and the light reception element. The sensor signal generated in the optical sensor 73 is output to the controller 100 (see FIG. 4).

The sheet discharge roller 62 (see FIG. 2) is provided with a second encoder disk 36 and an optical sensor 74 as shown in FIGS. 2 and 3. The second encoder disk 36 has the same shape as the first encoder disk 35. In FIG. 3, marks formed on the second encoder disk 36 are not shown. The second encoder disk 36 is fixed to the shaft 78 (see FIG. 3) of the sheet discharge roller 62 and rotates together with the sheet discharge roller 62. The optical sensor 74 includes a light emission element and a light reception element and is placed in the proximity of the sheet discharge roller 62. It is placed so that the circumference of the second encoder disk 36 is positioned in the space between the light emission element and the light reception element of the optical sensor 74. When the light reception element of the optical sensor 74 receives light, a sense signal is generated as with the optical sensor 73. The level of the sensor signal becomes low or high depending on whether a mark formed on the second encoder disk 36 positions between the light emission element and the light reception element. The sensor signal generated in the optical sensor 74 is output to the controller 100 (see FIG. 4).

<Controller 100>

Figure 4:
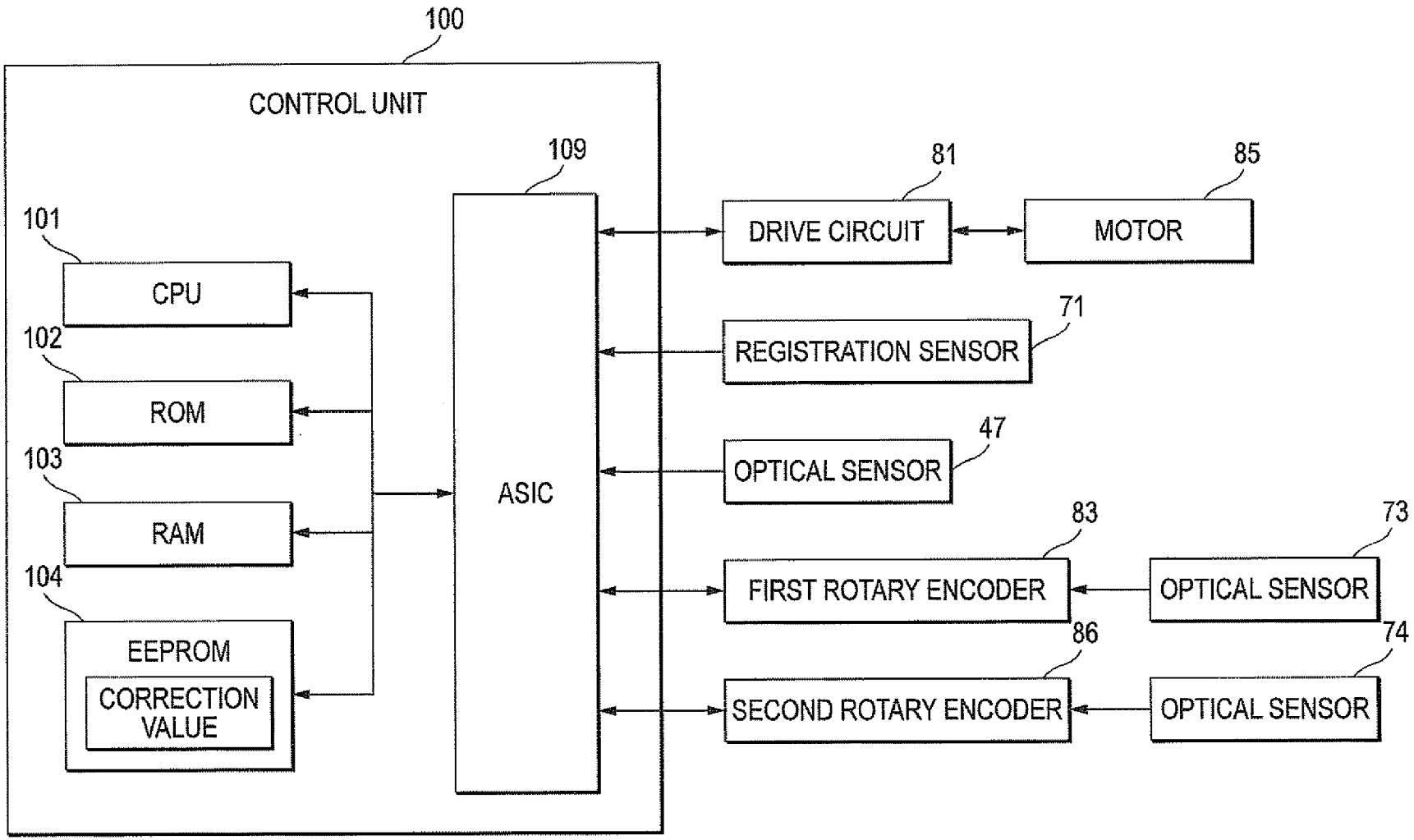
FIG. 4 is a block diagram to show the schematic configuration of a controller in the multifunction device.

Next, the schematic configuration of the controller 100 will be described with reference to FIG. 4. FIG. 4 is a block diagram to show the schematic configuration of the controller 100.

The controller 100 controls the whole operation of the multifunction device 10. It is implemented as a microcomputer including, as main components, a CPU 101, ROM 102, RAM 103, EEPROM 104, and an Application Specific Integrated Circuit (ASIC) 109 as shown in FIG. 4. The controller 100 controls the motor 85, the drive devices of the printer unit 11 and the scanner unit 12, and the like.

The ROM 102 stores programs for the CPU 101 to control the motor 85 and the multifunction device 10. A first target rotation amount described later is stored in the ROM 102. The first target rotation amount is an ideal rotation amount of the first encoder disk 35 corresponding to the unit feed amount described above. The RAM 103 is used as a storage area for temporarily storing various pieces of data used when the CPU 101 executes the program or a work area for data processing, and the like. A second target rotation amount described later is stored in the RAM 103. The EEPROM 104 stores settings, flags, and the like, to be retained still after the power is turned off. A correction value described later is stored in the EEPROM 104.

Connected to the ASIC 109 are the registration sensor 71, the optical sensor 47, a first rotary encoder 83, a second rotary encoder 86, and a drive circuit 81. Although not shown in FIG. 4, a drive circuit for driving the sheet feed roller 25, a head control circuit for controlling the record head 39, the operation panel 14, the scanner unit 12, and the like are also connected to the ASIC 109. Control of these components will not be described here.

The controller 100 not only determines the presence or absence of a record sheet 50, but also determines whether the leading end of the record sheet 50 reaches the position P1 or whether the trailing end of the record sheet 50 passes through the position P1 based on change in the sensor signal output from the registration sensor 71 (see FIG. 2).

The controller 100 not only determines the presence or absence of the record sheet 50 at the position P2, but also determines whether the leading end of the record sheet 50 reaches the position P2 or whether the trailing end of the record sheet 50 passes through the position P2 based on change in the detection signal output from the optical sensor 47 (see FIG. 2). The optical sensor 47 can also detect both end positions of the record sheet 50 in the process in which the carriage 38 is reciprocated.

The first rotary encoder 83 (see FIG. 4) counts the number of the marks of the first encoder disk 35 based on the detection result of the optical sensor 73, thereby detecting the rotation amount of the first encoder disk 35. Whenever the optical sensor 73 detects a mark of the first encoder disk 35, the sensor signal output from the optical sensor 73 makes a LOW to HIGH transition (see FIGS. 6A and 6B). The first rotary encoder 83 counts the number of times the sensor signal has made a LOW to HIGH transition per unit time, thereby detecting the rotation amount of the first encoder disk 35. Since the conveying roller 60 is rotated together with the first encoder disk 35, the rotation amount of the conveying roller 60 can be detected by detecting the rotation amount of the first encoder disk 35.

The second rotary encoder 86 counts the number of the marks of the second encoder disk 36 based on the detection result of the optical sensor 74, thereby detecting the rotation amount of the second encoder disk 36. Whenever the optical sensor 74 detects a mark of the second encoder disk 36, the sensor signal output from the optical sensor 74 makes a LOW to HIGH transition (see FIGS. 6A and 6B). The second rotary encoder 86 counts the number of times the sensor signal has made a LOW to HIGH transition per unit time, thereby detecting the rotation amount of the second encoder disk 36. Since the sheet discharge roller 62 is rotated together with the second encoder disk 36, the rotation amount of the sheet discharge roller 62 can be detected by detecting the rotation amount of the second encoder disk 36.

The motor 85 is connected to the drive circuit 81. The ASIC 109 makes a comparison between the detection result of the first rotary encoder 83 and the first target rotation amount stored in the ROM 102 in accordance with a command from the CPU 101. Based on this comparison result, the ASIC 109 generates a Pulse Width Modulation (PWM) signal as a first drive signal for driving the motor 85 and outputs the signal to the drive circuit 81. The drive circuit 81 outputs an electric current according to the PWM duty of the first drive signal input from the ASIC 109 to the motor 85. The PWM duty refers to a ratio of the ON time to one cycle time in the drive signal. Thus, the motor 85 is driven by the drive signal through the drive circuit 81, whereby the controller 100 controls driving of the motor 85. The rotation force of the motor 85 is transmitted through the drive transmission mechanism 90 previously described with reference to FIG. 3 to the conveying roller 60 and the sheet discharge roller 62 shown in FIG. 2. The controller 100 controls driving of the motor 85 based on the detection result of the first rotary encoder 83 and the detection result of the second rotary encoder 86. In other words, the controller 100 controls driving of the motor 85 based on the rotation amount of the conveying roller 60 detected by the first rotary encoder 83 and the rotation amount of the sheet discharge roller 62 detected by the second rotary encoder 86.

Figure 5:
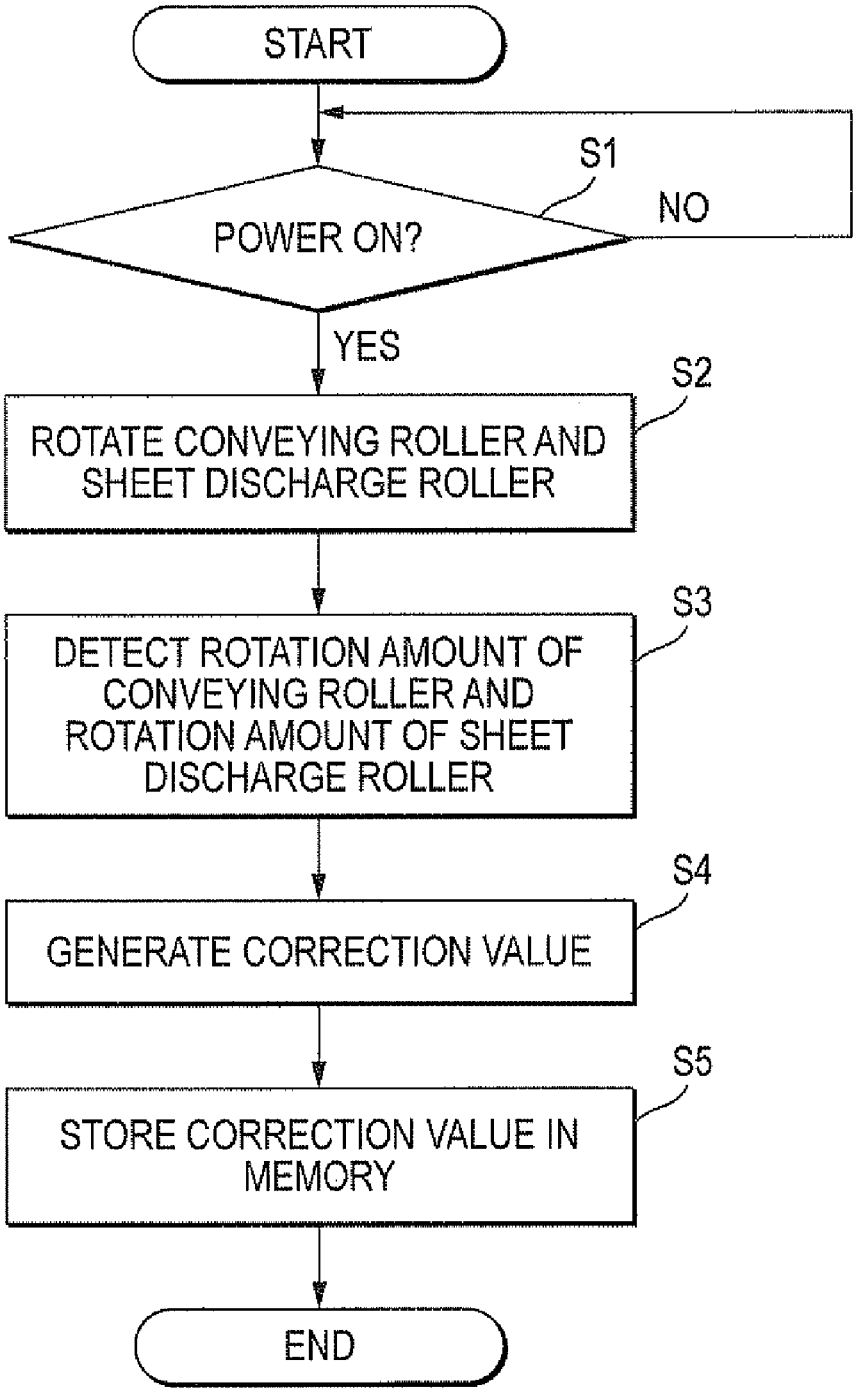
FIG. 5 is a flowchart to show an exemplary procedure of correction value generation processing executed by the controller.

FIG. 5 is a flowchart to show an exemplary procedure of correction value generation processing executed by the controller 100. The following processing described based on the flowchart of FIG. 5 is performed in accordance with a command issued by the controller 100 according to the program stored in the ROM 102.

The controller 100 determines whether power of the multi function device 10 is turned on based on whether a power button provided on the operation panel 14 is pressed (S1). If the controller 100 does not determine that the power of the multifunction device 10 is turned on (NO at S1), the controller 100 enters a wait state. If the controller 100 determines that the power of the multifunction device 10 is turned on (YES at S1), the controller 100 generates a drive signal and outputs the drive signal through the drive circuit 81 to the motor 85, thereby rotating the conveying roller 60 and the sheet discharge roller 62 (S2).

Next, the rotation amount of the conveying roller 60 and the rotation amount of the sheet discharge roller 62 are detected (S3). Specifically, the first rotary encoder 83 counts the number of times the sensor signal output from the optical sensor 73 has made a LOW to HIGH transition within a predetermined time period, thereby detecting the rotation amount of the conveying roller 60. At the same time, the second rotary encoder 86 counts the number of times the sensor signal output from the optical sensor 74 has made a LOW to HIGH transition within the predetermined time period, thereby detecting the rotation amount of the sheet discharge roller 62.

The controller 100 generates a correction value based on the rotation amount of the conveying roller 60 detected by the first rotary encoder 83 and the rotation amount of the sheet discharge roller 62 detected by the second rotary encoder 86 (S4). The correction value is data for correcting the drive signal (second drive signal described later) output to the motor 85. At this step S4, the controller 100 finds a correction value according to the inverse of the ratio of the rotation amount of the sheet discharge roller 62 to the rotation amount of the conveying roller 60.

Figure 6A:
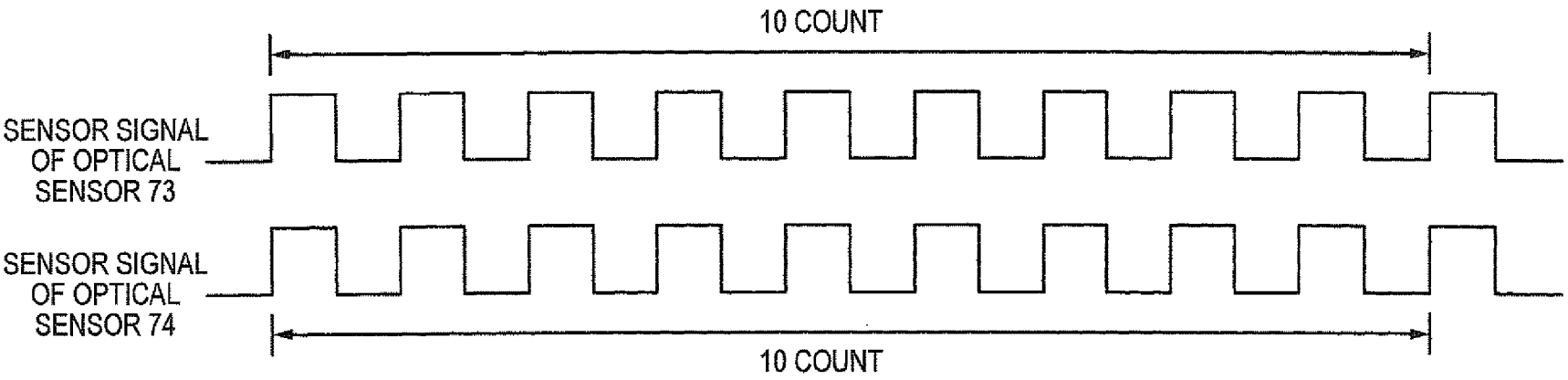
FIGS. 6A and 6B are schematic representations to illustrate the sensor signals output from optical sensors in the multifunction device.
Figure 6B:
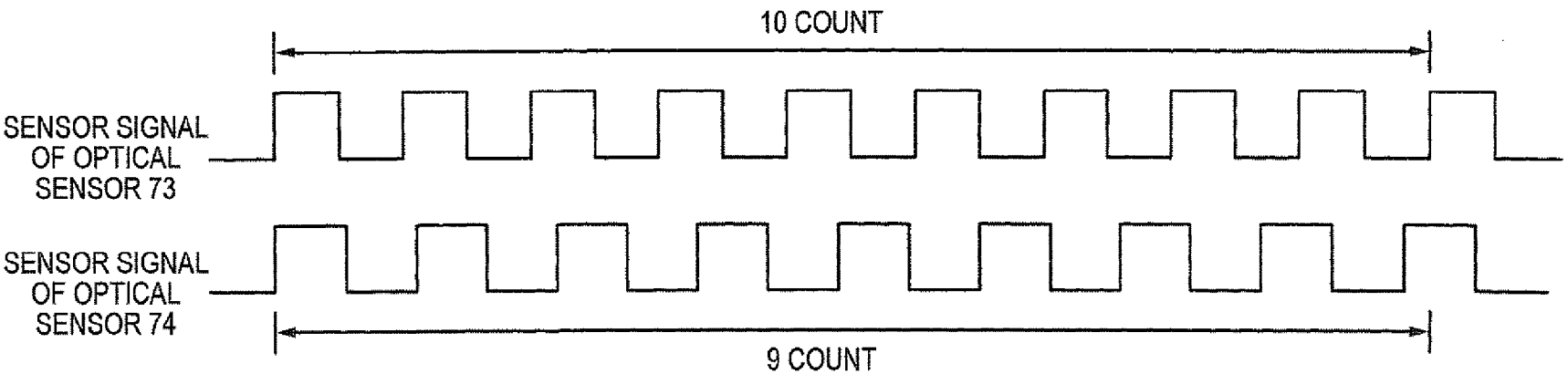

FIGS. 6A and 6B are a schematic representation to illustrate the sensor signals output from the optical sensors 73 and 74. FIG. 6A shows a state in which the number of times the sensor signal output from the optical sensor 73 has made a LOW to HIGH transition per unit time is equal to the number of times the sensor signal output from the optical sensor 74 has made a LOW to HIGH transition per unit time. FIG. 6B shows a state in which the number of times the sensor signal output from the optical sensor 73 has made a LOW to HIGH transition per unit time differs from the number of times the sensor signal output from the optical sensor 74 has made a LOW to HIGH transition per unit time.

If the sensor signals shown in FIG. 6A are output from the optical sensors 73 and 74, specifically the correction value is found as follows: The count of the sensor signal by the first rotary encoder 83 per unit time and the count of the sensor signal by the second rotary encoder 86 per unit time are both "10" and equal with each other, as shown in FIG. 6A. This means that eccentricity of the shaft 76 of the conveying roller 60 or the shaft 78 of the sheet discharge roller 62, a dimension error of the conveying roller 60 and the sheet discharge roller 62, an attachment error of the drive transmission mechanism 90, and the like, does not exist. In this case, the controller 100 generates a correction value "1."

If the sensor signals shown in FIG. 6B are output from the optical sensors 73 and 74, specifically the correction value is found as follows: The count of the sensor signal by the first rotary encoder 83 per unit time is "10" and the count of the sensor signal by the second rotary encoder 86 per unit time is "9", as shown in FIG. 6B. That is, the rotation amounts of the conveying roller 60 and the sheet discharge roller 62 differ. The difference is caused by eccentricity of the shaft 76 of the conveying roller 60 or the shaft 78 of the sheet discharge roller 62, a dimension error of the conveying roller 60 and the sheet discharge roller 62, an attachment error of the drive transmission mechanism 90, and the like. The controller 100 generates a correction value "10/9" according to the inverse of the ratio "9/10" of the rotation amount "9" of the sheet discharge roller 62 to the rotation amount "10" of the conveying roller 60.

The controller 100 stores the correction value generated at step S4 in the EEPROM 14 (S5). If the sensor signals shown in FIG. 6B are output from the optical sensors 73 and 74, the correction value "10/9" is stored in the EEPROM 14.

Figure 7:
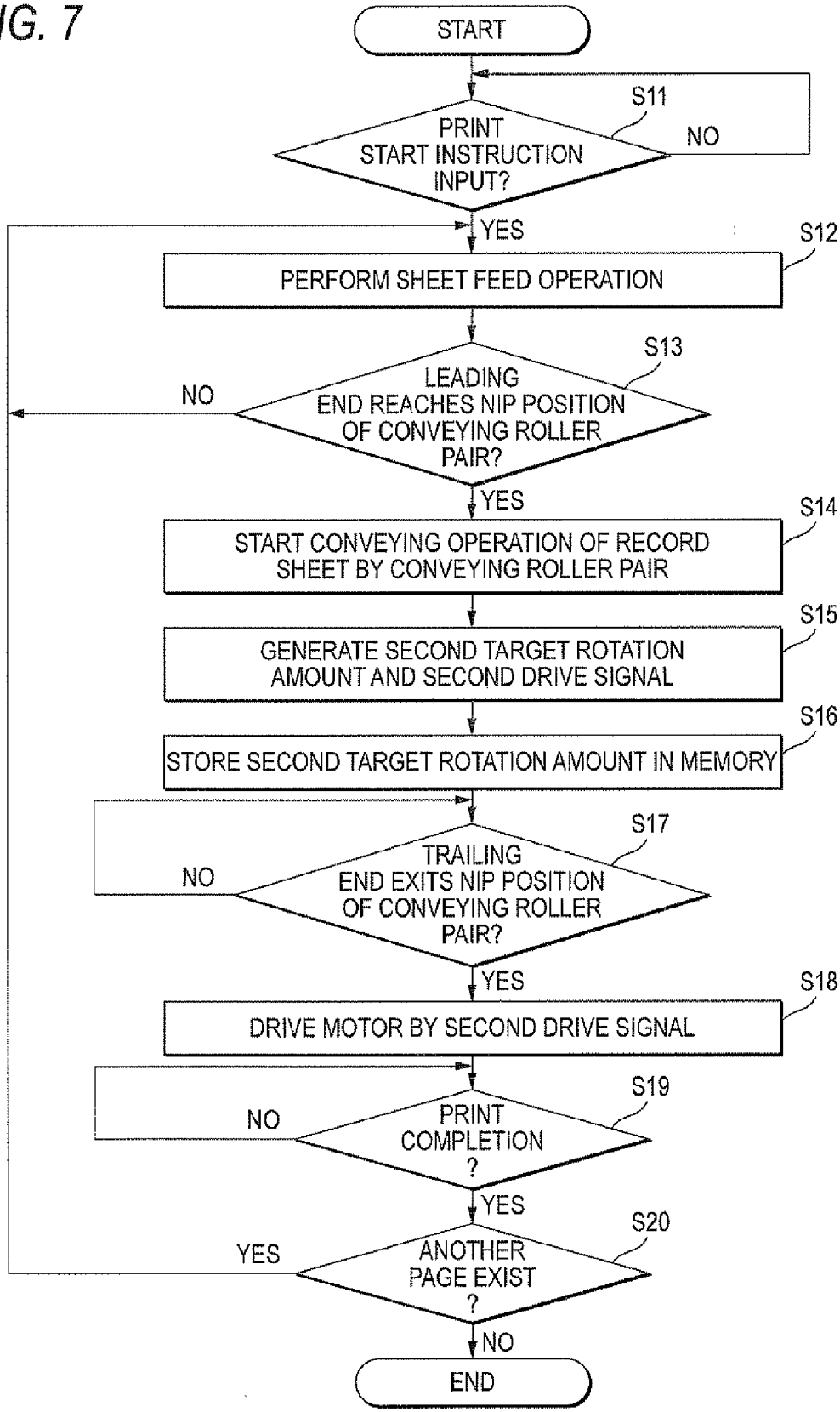
FIG. 7 is a flowchart to show an exemplary control procedure of a motor executed by the controller.

FIG. 7 is a flowchart to show an exemplary control procedure of the motor 85 executed by the controller 100.

The controller 100 determines whether a print start instruction is input (S11). Specifically, the controller 100 determines whether the user enters a print start command through the operation panel 14 or whether a print start command and print data are received from an external system. If the controller 100 does not determine that a print start instruction is input (NO at S11), the controller 100 enters a wait state. If the controller 100 determines that a print start instruction is input (YES at S11), the controller 100 executes sheet feed operation (S12). Specifically, the controller 100 drives the sheet feed roller 25 for feeding a record sheet 50 housed in the sheet feed tray 20 to the conveying passage 23.

Next, the controller 100 determines whether the leading end of the record sheet 50 fed to the conveying passage 23 reaches the nip position of the conveying roller pair 59 (see FIG. 2) (S13). The determination at step S13 can be made by determining whether the sheet feed roller 25 has rotated a predetermined amount since the registration sensor 71 detected the leading end of the record sheet 50. The predetermined amount corresponds to the distance from the registration sensor 71 to the nip position of the conveying roller pair 59; for example, the number of revolutions of the sheet feed roller 25, the number of control steps of the motor for driving the sheet feed roller 25, and the like, is used. If the controller 100 does not determine that the leading end of the record sheet 50 reaches the nip position of the conveying roller pair 59 (NO at S13), step S12 is continued. If the leading end of the record sheet 50 reaches the nip position of the conveying roller pair 59, registration operation is performed. The registration operation is operation of rotating the sheet feed roller 25 in a state in which the leading end of the record sheet 50 is struck against the nip position of the conveying roller pair 59. Accordingly, the leading end of the record sheet 50 is aligned.

If the controller 100 determines that the leading end of the record sheet 50 reaches the nip position of the conveying roller pair 59 (YES at S13), the conveying operation of the record sheet 50 by the conveying roller pair 59 is started (S14) after the registration operation is complete. At step S14, the drive circuit 81 outputs an electric current according to the PWM duty of the first drive signal generated by the controller 100 to the motor 85, whereby the motor 85 is driven. The drive force of the motor 85 is transmitted to the shafts 76 and 78 (see FIG. 3) through the drive transmission mechanism 90 and the conveying roller 60 and the sheet discharge roller 62 are synchronously rotated. Accordingly, the record sheet 50 is conveyed in the conveying direction 17. When the motor 85 is driven, the first rotary encoder 83 detects the rotation amount of the conveying roller 60. That is, the first rotary encoder 83 counts the number of times the sensor signal output from the optical sensor 73 has made a LOW to HIGH transition, thereby detecting the rotation amount of the conveying roller 60. The first drive signal is generated based on the rotation amount of the conveying roller 60 thus detected by the first rotary encoder 83. As the motor 85 is driven by the first drive signal, the record sheet 50 is conveyed in the conveying direction 17 at predetermined conveying speed according to the resolution of an image recorded on the record sheet 50. An image is recorded on the record sheet 50 in the conveying process. The first drive signal is generated so that the rotation amount of the conveying roller 60 (first encoder disk 35) detected by the first rotary encoder 83 becomes equal to the first target rotation amount. That is, the first drive signal is generated so that the motor 85 rotates in a predetermined rotation amount according to the resolution of an image recorded on the record sheet 50.

When the first drive signal becomes stable, the controller 100 generates a second target rotation amount and a second drive signal (S 5). At S15, the controller 100 generates the second target rotation amount by multiplying the correction value stored in the EEPROM 104 by the first target rotation amount stored in the ROM 102, for example. The controller 100 generates the second drive signal based on the comparison result between the detection result of the second rotary encoder 86 and the second target rotation amount. The second drive signal is generated so that the rotation amount of the sheet discharge roller 62 (second encoder disk 36) detected by the second rotary encoder 86 becomes equal to the second target rotation amount. The second target rotation amount is stored in the RAM 103 (S16).

The controller 100 determines whether the trailing end of the record sheet 50 reaches a position where it exits the nip position of the conveying roller pair 59 (S17). In other words, the controller 100 determines whether the record sheet 50 enters a state in which it is conveyed only by the discharge roller pair 64 from the state in which the record sheet 50 is conveyed by the conveying roller pair 59 and the discharge roller pair 64. Step S17 is executed by determining whether the record sheet 50 has been conveyed a predetermined amount since the optical sensor 47 detected the trailing end of the record sheet 50, for example, based on the detection result of the first rotary encoder 83. The predetermined amount corresponds to the distance resulting from subtracting the distance from the nip position of the conveying roller pair 59 to the position P2 from the length of the record sheet 50 in the conveying direction 17. If the controller 100 does not determine that the trailing end of the record sheet 50 exits the nip position of the conveying roller pair 59 (NO at S17), the process is returned to step S17.

Meanwhile, when the leading end of the record sheet 50 reaches the nip position of the discharge roller pair 64, the record sheet 50 is conveyed by the conveying roller pair 59 and the discharge roller pair 64. In the exemplary embodiment, the force of the pinch roller 61 for coming in press contact with the conveying roller 60 (press contact force F1) is larger than the force of the spur roller 63 for coming in press contact with the sheet discharge roller 62 (press contact force F2). Thus, when the record sheet 50 is conveyed by both the conveying roller pair 59 and the discharge roller pair 64, a slip of the record sheet 50 relative to the discharge roller pair 64 may occur. Therefore, if the record sheet 50 is being conveyed by the conveying roller pair 59 and the discharge roller pair 64, the record sheet 50 is conveyed at the conveying speed according to the first drive signal.

If the controller 100 determines that the trailing end of the record sheet 50 exits the nip position of the conveying roller pair 59 (YES at S17), the controller 100 drives the motor 85 by the second drive signal stored in the RAM 103 at step S16 (S20). That is, the controller 100 gives the second drive signal to the drive circuit 81 and the drive circuit 81 outputs an electric current according to the PWM duty of the second drive signal to the motor 85. The drive signal is changed according to the second target rotation amount provided by multiplying the first target rotation amount by the correction value, so that the drive force of the motor 85 can be changed easily. This means that the second drive signal is generated based on the comparison result between the detection result of the second rotary encoder 86 and the second target rotation amount. Therefore, the electric current output from the drive circuit 81 to the motor 85 can be changed easily.

The controller 100 determines whether the print is complete (S19). The determination at step S19 is made based on whether the record sheet 50 has been conveyed a predetermined amount since the optical sensor 47 detected the trailing end of the record sheet 50, for example. The predetermined amount corresponds to the distance from the position P2 to the nip position of the discharge roller pair 64. The determination at step S19 is repeated until the controller 100 determines that the print is complete.

Thus, the controller 100 drives the motor 85 by the first drive signal according to the rotation amount of the conveying roller 60 until the trailing end of the record sheet 50 exits the nip position of the conveying roller pair 59. After the trailing end of the record sheet 50 exits the nip position of the conveying roller pair 59, the controller 100 drives the motor 85 by the second drive signal. That is, the motor 85 is driven by the second drive signal after the record sheet 50 enters the state in which it is conveyed only by the discharge roller pair 64 from the state in which the record sheet 50 is conveyed by the conveying roller pair 59 and the discharge roller pair 64.

If the controller 100 determines that the print is complete (YES at S19), the controller 100 determines whether print data of another page exists (S20). If the controller 100 determines that print data of another page exists (YES at S20), step S12 and the later steps are repeated. If the controller 100 does not determine that print data of another page exists (NO at S20), the processing ends.

<Function and Effect of Exemplary Embodiments>

The rotation amount of the conveying roller 60 and the rotation amount of the sheet discharge roller 62 may differ because of eccentricity of the shaft 76 of the conveying roller 60 or the shaft 78 of the sheet discharge roller 62, a dimension error of the conveying roller 60 and the sheet discharge roller 62, an attachment error of the drive transmission mechanism 90, and the like. After the trailing end of the record sheet 50 exits the nip position of the conveying roller pair 59, the correction value is added to the first drive signal to change the drive force of the motor 85 as described above. Thus, the rotation amount of the conveying roller 60 before the trailing end of the record sheet 50 exits the nip position of the conveying roller pair 59 and the rotation amount of the sheet discharge roller 62 after the trailing end of the record sheet 50 exits the nip position of the conveying roller pair 59 become equal. Consequently, the conveying speed of the record sheet 50 does not change before and after the trailing end of the record sheet 50 exits the nip position of the conveying roller pair 59, so that occurrence of turbulence in the image recorded on the record sheet 50 may be reduced or prevented.

In the description of the exemplary embodiment, the correction value is generated when the power of the multifunction device 10 is turned on, but the timing at which the correction value is generated is not limited to it. For example, if the printer unit 11 has a function of cleaning the record head 39, the correction value may be generated each time cleaning is performed. The correction value may be generated every preset constant period. The correction value may be generated while the record sheet 50 is being conveyed because the correction value may be provided by the time the trailing end of the record sheet 50 exits the nip position of the conveying roller pair 59. To generate the correction value when the record sheet 50 is not conveyed as in the exemplary embodiment, however, the correction value is generated in a state in which no effect is received from the record sheet 50 and thus a more preferred correction value may be provided as compared with the case where the correction value is generated while the record sheet 50 is being conveyed.

In the description of the exemplary embodiment, the optical sensor 47 (see FIG. 2) detects the record sheet 50, but the registration sensor 71 may detect the leading end or the trailing end of the record sheet 50.

Modified Example

The spur roller 63 may be brought into press contact with the sheet discharge roller 62 by the press contact force (press contact force F2) larger than the force of the pinch roller 61 for coming in press contact with the conveying roller 60 (press contact force F1). In this case, the record sheet 50 is conveyed upon reception of the force of only the conveying roller 60 until the leading end of the record sheet 50 reaches the nip position of the discharge roller pair 64. When the leading end of the record sheet 50 reaches the nip position of the discharge roller pair 64, the record sheet 50 is conveyed mainly upon reception of the force of the sheet discharge roller 62 because of the relationship between the press contact forces F1 and F2.

In the modified example, the controller 100 performs the following determination processing in place of the determination processing at step S17 described above: The controller 100 determines whether the leading end of the record sheet 50 reaches the nip position of the discharge roller pair 64. If the controller 100 does not determine that the leading end of the record sheet 50 reaches the nip position of the discharge roller pair 64, the process is returned to step S17 described above. If the controller 100 determines that the leading end of the record sheet 50 reaches the nip position of the discharge roller pair 64, the process proceeds to step S18 described above.

Accordingly, when the record sheet 50 is being conveyed only by the conveying roller pair 59, the record sheet 50 is conveyed by the conveying roller pair 59 at the conveying speed according to the first drive signal. When the leading end of the record sheet 50 reaches the nip position of the discharge roller pair 64, the record sheet 50 is conveyed by the conveying roller pair 59 and the discharge roller pair 64 at the conveying speed according to the second drive signal. The rotation amount of the sheet discharge roller 62 of the discharge roller pair 64 wherein a slip of the record sheet 50 does not occur is changed and becomes equal to the rotation amount of the conveying roller 60 before the leading end of the record sheet 50 reaches the nip position of the discharge roller pair 64. Consequently, the conveying speeds of the record sheet 50 before and after the leading end of the record sheet 50 reaches the nip position of the discharge roller pair 64 become constant and occurrence of turbulence in the image recorded on the record sheet 50 may be reduced or prevented.

What is claimed is:

1. An image recording apparatus comprising:

a record unit which records an image on a record medium conveyed in a conveying direction in a conveying passage;

a first roller which is provided upstream of the record unit in the conveying direction in the conveying passage;

a second roller which is provided downstream of the record unit in the conveying direction in the conveying passage;

a motor which drives the first roller and the second roller;

a drive transmission mechanism which transmits a drive force of the motor to the first roller and the second roller;

a first detection unit which detects a first rotation amount of the first roller;

a second detection unit which detects a second rotation amount of the second roller;

a storage unit which stores a first target rotation amount;

a first drive signal generation unit which generates a first drive signal based on the first rotation amount detected by the first detection unit and the first target rotation amount stored in the storage unit;

a correction value generation unit which generates a correction value based on the first rotation amount detected by the first detection unit and the second rotation amount detected by the second detection unit;

a target value generation unit which generates a second target rotation amount based on the first target rotation amount stored in the storage unit and the correction value generated by the first correction generation unit;

a second drive signal generation unit which generates a second drive signal based on the second target rotation amount generated by the second generation unit and the second rotation amount detected by the second detection unit; and a controller which controls the motor by the first drive signal until the conveyed record medium reaches a predetermined position in the conveying passage and controls the motor by the second drive signal after the conveyed record medium reaches the predetermined position.

2. The image recording apparatus according to claim 1, further comprising:

a first auxiliary roller which is supported to be freely rotatable and brought into press contact with the first roller by a first press contact force; and a second auxiliary roller which is supported to be freely rotatable and brought into press contact with the second roller by a second press contact force smaller than the first press contact force, wherein the predetermined position is a position where a trailing end of the record medium conveyed in the conveying passage exits a contact position of the first roller and the first auxiliary roller.

3. The image recording apparatus according to claim 1, further comprising:

a first auxiliary roller which is supported to be freely rotatable and brought into press contact with the first roller by a first press contact force; and a second auxiliary roller which is supported to be freely rotatable and brought into press contact with the second roller by a second press contact force larger than the first press contact force, wherein the predetermined position is a position where a leading end of the record medium conveyed in the conveying passage reaches a contact position of the second roller and the second auxiliary roller.

4. The image recording apparatus according to claim 1, wherein the correction value generation unit generates the correction value when the record medium is not conveyed.

5. The image recording apparatus according to claim 1, wherein the correction value generation unit finds the correction value according to the inverse of a ratio of the second rotation amount to the first rotation amount.

6. The image recording apparatus according to claim 1, wherein the first roller and the second roller are synchronously driven by the drive transmission mechanism.

7. The image recording apparatus according to claim 1, wherein the first target rotation amount corresponds to a resolution of the image to be recorded on the record medium.

8. The image recording apparatus according to claim 1, wherein the correction value generation unit generates the correction value when the record medium is conveyed.

9. The image recording apparatus according to claim 8, wherein the correction value generation unit generates the correction value until the conveyed record medium reaches the predetermined position in the conveying passage.

10. An image recording apparatus comprising;

first roller pair and second roller pair which convey a record medium in a conveying passage in a conveying direction;

a record unit which records an image on the record medium;

a motor;

a transmission mechanism which transmits a rotation of the motor to the first roller pair and the second roller pair;

first and second detection units which detect a first rotation speed of the first roller pair and a second rotation speed of the second roller pair, respectively;

a rotation ratio calculating unit which calculates a ratio of the second rotation speed to the first rotation speed; and a controller which controls the motor with using the ratio calculated by the rotation calculating unit.

11. The image recording apparatus according to claim 10, further comprising a medium detection unit which detects that the conveyed record medium reaches a predetermined position;

wherein the controller controls the motor with using the ratio after the medium detection unit detects that the conveyed record medium reaches the predetermined position.

12. The image recording apparatus according to claim 11, further comprising:

a first obtaining unit which obtains a first target speed; and a second obtaining unit which obtains a second target speed based on the first target speed and the ratio, wherein the controller controls the motor such that the first rotation speed becomes the first target speed until the medium detection unit detects that the conveyed record medium reaches the predetermined position, and wherein the controller controls the motor such that the second rotation speed becomes the second target speed after the medium detection unit detects that the conveyed record medium reaches the predetermined position.

* * * * *